US008304090B2

(12) United States Patent
Demers

(10) Patent No.: US 8,304,090 B2
(45) **Date of Patent: *Nov. 6, 2012**

(54) HIGH THERMAL CONDUCTIVITY, HIGH YIELD STRENGTH METAL COMPOSITE AND METHOD

(76) Inventor: Joseph R. Demers, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/100,242

(22) Filed: May 3, 2011

(65) Prior Publication Data

US 2011/0223440 A1 Sep. 15, 2011

Related U.S. Application Data

(63) Continuation of application No. 11/439,393, filed on May 22, 2006, now Pat. No. 7,960,032.

(60) Provisional application No. 60/683,735, filed on May 24, 2005, provisional application No. 60/683,764, filed on May 24, 2005, provisional application No. 60/711,760, filed on Aug. 29, 2005.

(51) Int. Cl.
*B32B 7/02* (2006.01)
*B32B 7/04* (2006.01)

(52) U.S. Cl. ..... 428/614

(58) Field of Classification Search ..... 428/614
See application file for complete search history.

(56) References Cited

U.S. PATENT DOCUMENTS

| | | | | |
|---|---|---|---|---|
| 1,991,496 | A | 2/1935 | Derby | |
| 4,996,115 | A * | 2/1991 | Eerkes et al. | 428/614 |
| 5,106,433 | A | 4/1992 | Nakamura et al. | |
| 5,835,518 | A | 11/1998 | Mundinger et al. | |
| 6,081,997 | A * | 7/2000 | Chia et al. | 29/841 |
| 6,147,341 | A | 11/2000 | Lemaire et al. | |
| 7,905,335 | B2 | 3/2011 | Demers | |
| 2004/0124493 | A1 * | 7/2004 | Chua | 257/508 |
| 2006/0269774 | A1 | 11/2006 | Demers | |

FOREIGN PATENT DOCUMENTS

WO WO 02087294 A1 * 10/2002

OTHER PUBLICATIONS

Aluminum Oxide Material Data, http://www.accuratus.com/alumox.html, printed Mar. 8, 2010.*
316 Stainless Steel Materials Data, http://www.azom.com/details.asp?ArticleID=2868, printed Mar. 8, 2010.*
Properties of Metals Table, http://www.engineersedge.com/properties of metals.htm, printed Aug. 5, 2009.*
Properties of Metals Table, http://www.engineersedge.com/properties_of_metals.htm, printed Aug. 5, 2009.

* cited by examiner

*Primary Examiner* — Jennifer McNeil
*Assistant Examiner* — Adam Krupicka
(74) *Attorney, Agent, or Firm* — Pritzkau Patent Group, LLC

(57) ABSTRACT

An exemplary embodiment providing one or more improvements includes a composite structure of materials that are formed together in a way which gives the composite structure improved yield strength and thermal conduction capabilities.

2 Claims, 12 Drawing Sheets

HIGH THERMAL CONDUCTIVITY, HIGH YIELD STRENGTH METAL COMPOSITE AND METHOD

RELATED APPLICATIONS

The present application is a continuation application of copending U.S. patent application Ser. No. 11/439,393, filed on May 22, 2006 U.S. Pat. No. 7,960,032 which issued on Jun. 14, 2011; which claimed priority from U.S. Provisional Application Ser. No. 60/683,735, filed on May 24, 2005, U.S. Provisional Application Ser. No. 60/683,764, filed on May 24, 2005, and U.S. Provisional Application Ser. No. 60/711,760, filed on Aug. 29, 2005, all of which are incorporated herein by reference.

BACKGROUND

A composite may be described as a material produced by combining materials differing in composition or form on a macroscopic scale to obtain specific characteristics and properties. In these composites, the constituents retain their identity, can be physically identified, and often exhibit an interface between one another. For instance, a clad metal is a composite that contains two or more layers of different metal that have been bonded together. The bonding may be accomplished by co-rolling, co-extrusion, welding, diffusion bonding, casting, heavy chemical deposition, or heavy electroplating. Clad metals are commonly found on the bottoms of household pots and pans. Copper or aluminum is clad to the stainless steel pan as a way to improve the thermal conduction and de-localize heat from a burner to the entirety of the pan. For a household pan, the cladding process is usually achieved by diffusion bonding, which generally is compressing the two dissimilar metals together with high pressure at high temperatures.

While the clad arrangement described above can produce a composite with the physical properties of both metals (i.e. it is a sheet of copper bonded to a sheet of steel). In an application where a high temperature piston applies a high force normal to the copper and steel sheets, the piston would deform the low yield strength copper rather easily, regardless of the thickness of the steel sheet. While the copper is adequate for conducting the heat from the piston, it cannot handle the applied forces without deformation, particularly when at elevated temperature. Most common materials with significant thermal conductivity will either have a low melting point (like aluminum) or a low yield strength (like copper) and cannot be employed for the application of cooling a high temperature piston. While there are non-composite high thermal conductivity, high yield strength exotic materials like Copper Tungsten (CuW) which can be used for this demanding application, they are economically unfeasible for many applications.

In some instances, it is necessary or desirable to have a three dimensional composite structure that exhibits a desirable property in one dimension more than in another dimension, while the structure exhibits another desirable proper in another dimension. An example of this would be a three dimensional composite sheet that has a thermal conductivity that is higher in one direction through the sheet and has a high yield or compressive strength in another direction through the sheet.

The foregoing examples of the related art and limitations related therewith are intended to be illustrative and not exclusive. Other limitations of the related art will become apparent to those of skill in the art upon reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In general, composites and methods of constructing a three dimensional structure are described which provide for improved characteristics in the structure. A method for producing a three dimensional composite sheet for withstanding a compressive force normal to a major surface of the composite sheet is disclosed. The major surface of the composite sheet is defined by a first and a second dimension of the composite sheet. The composite sheet withstands the compressive force while conducting heat along at least one of the first and the second dimensions of the composite sheet more efficiently than heat is conducted along a third, thickness dimension of the composite sheet. The composite sheet is produced by forming a pattern in a first high yield strength sheet material by removing the first material to a predetermined degree in at least a first selected region of the first material and by forming a complementary pattern in a second high thermal conductivity sheet material. The first material and the second material are combined into the three dimensional composite sheet so that the pattern and the complementary pattern cooperate to cause the first material to primarily withstand the compressive force and the second material to primarily conduct the heat in the composite sheet.

In another embodiment, a method is disclosed for producing a composite sheet made from a first material and a second material where the composite sheet has an overall compressive strength that is higher than a compressive strength of the second material and has an overall thermal conductivity that is higher than a thermal conductivity of the first material. The method includes forming the first material in full thickness areas and in reduced thickness areas and forming the second material in the reduced thickness areas of the first material to produce an overall thickness that is substantially the same as the thickness of the full thickness areas.

In another embodiment, a three dimensional composite sheet is disclosed having a major surface defined by a first and a second dimension of the composite sheet and a thickness defined by a third dimension of the composite sheet. The composite sheet having a first material and a second material which combine to give the composite sheet an overall compressive strength that is higher than a compressive strength of the second material and an overall thermal conductivity that is higher than a thermal conductivity of the first material. The composite sheet including a first sheet material area of the composite sheet surface which is defined by at least a portion of a first sheet material for primarily withstanding the compressive force substantially normal to the composite sheet surface and a second sheet material area of the composite sheet surface which is defined by at least a portion of the second sheet material for primarily conducting the heat along the at least one of the first and second dimensions of the composite sheet.

In addition to the exemplary aspects and embodiments described above, further aspects and embodiments will become apparent by reference to the drawings and by study of the following descriptions.

DETAILED DESCRIPTION

Figure 1:
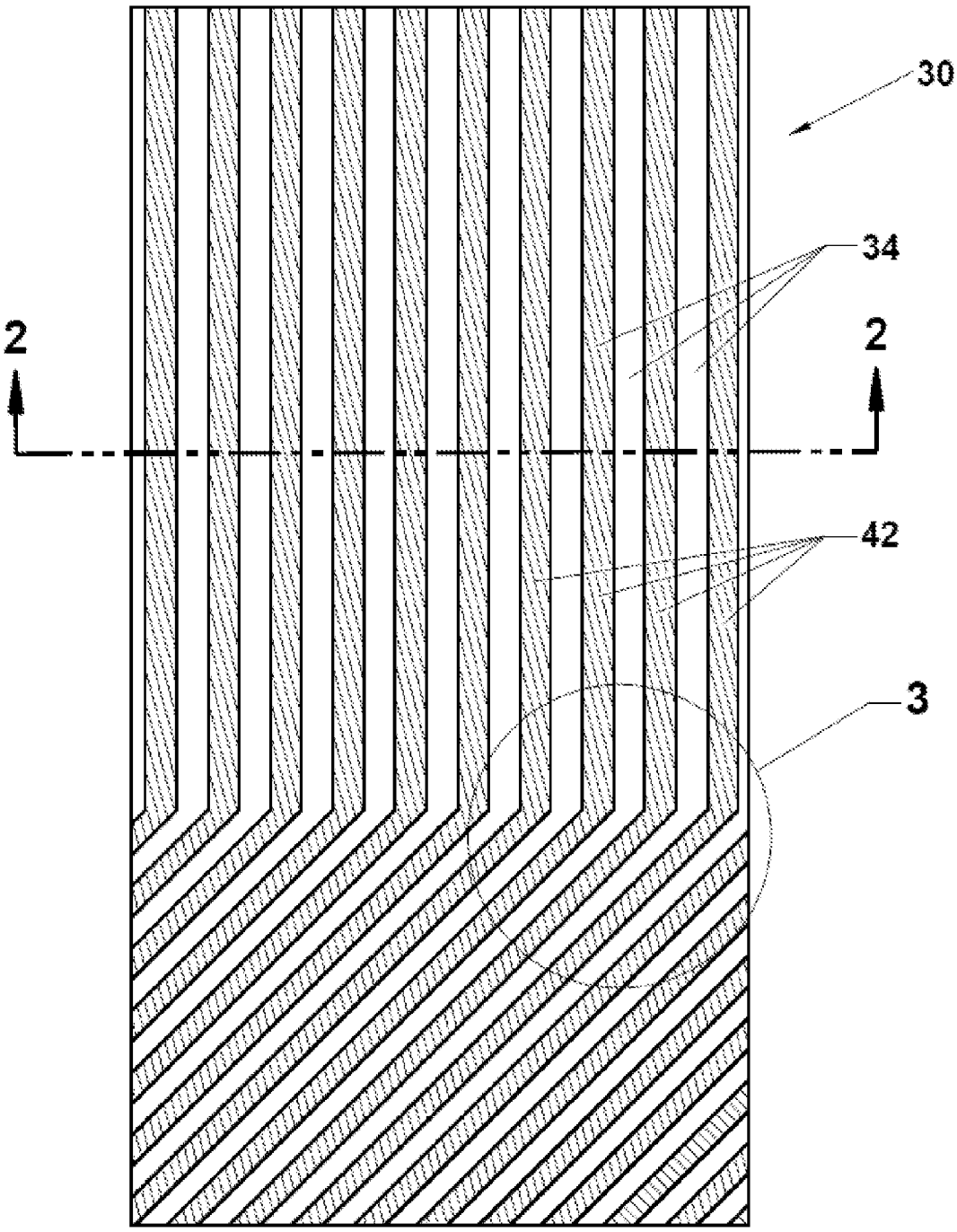
FIG. 1 is a plan view of a composite sheet which incorporates the present disclosure.
Figure 2:
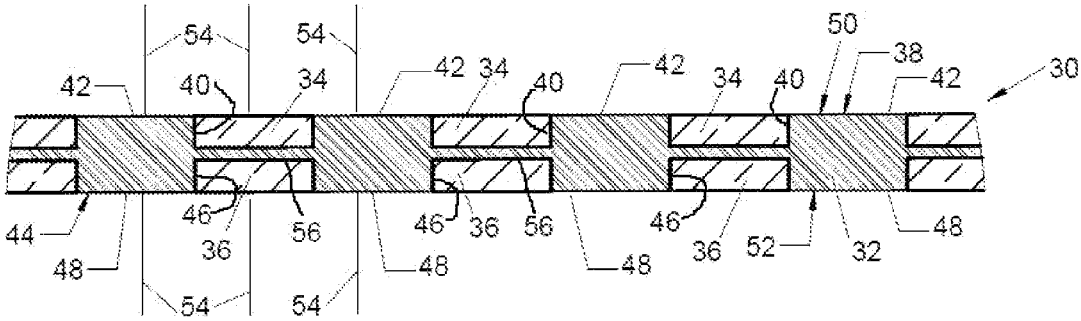
FIG. 2 is an enlarged partial cross section view of the composite sheet taken along line 2-2 shown in FIG. 1.
Figure 3:
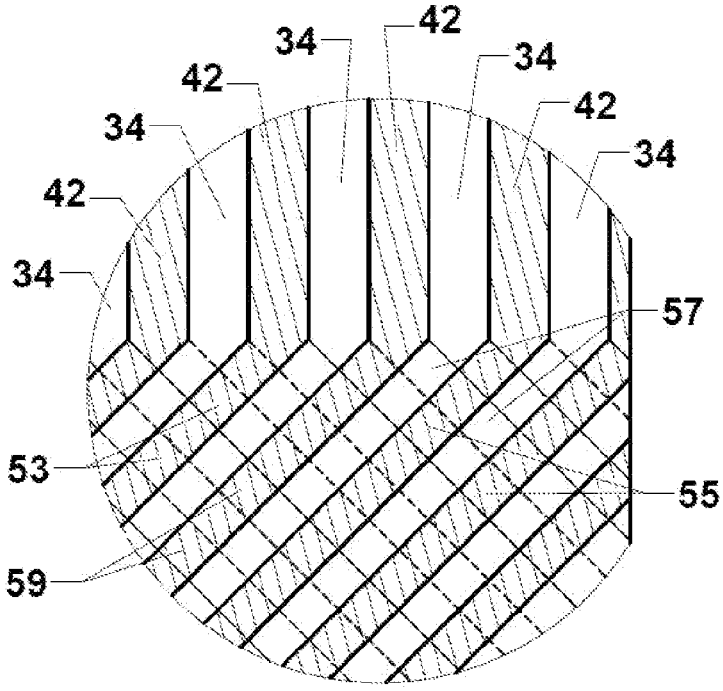
FIG. 3 is an enlarged partial cut-away view of the composite sheet taken from area 3 shown in FIG. 1.

A composite sheet 30 according to the present disclosure is shown in FIGS. 1-3. FIG. 1 shows composite sheet 30 in a plan view, FIG. 2 shows partial cross section view of composite sheet 30 and FIG. 3 shows a detail of composite sheet 30. Composite sheet 30 includes a base material sheet 32 (FIG. 2) of a first material that is patterned with traces 34 and 36 of a second material. The base sheet 32 includes an upper surface 38 with upper recesses 40 that are separated by upper crowns 42 and a lower surface 44 with lower recesses 46 that are separated by lower crowns 48. In the example shown in FIG. 2, traces 34 of the second material fill upper recesses 40 to the point where a generally planar surface 50 is created on the upper side of composite sheet 30, and traces 36 fill lower recesses 46 to the point where a generally planar surface 52 is created on the lower side of composite sheet 30.

In composite sheet 30, base sheet 32 is constructed from stainless steel. Stainless steel has a high yield or compressive strength which allows composite sheet 30 to withstand high compressive forces such as the compressive force applied normal to the upper and lower surfaces 50 and 52 represented by arrows 54. The stainless steel of base sheet 32 is the primary structure for withstanding the compressive and other physical forces on the composite sheet 30 provided that the force is distributed across a sufficiently broad area of the surface of the sheet. Base sheet 32 can also be constructed of any other suitable material that has a high compressive strength.

While base sheet 32 primarily withstands physical forces on the composite sheet 30, traces 34 and 36 are primarily responsible for conducting heat through and along composite sheet 30. Traces 34 and 36 in composite sheet 30 shown in FIGS. 1 and 2 are constructed from copper, although any other suitable material with high thermal conductivity could also be used. Copper has a relatively low yield or compressive strength, especially in comparison to stainless steel, on the other hand, stainless steel does not have as high a thermal conductivity as copper does. Therefore, since composite sheet 30 includes base sheet 32 of stainless steel and traces 34 and 36 of copper, composite sheet 30 has a yield strength, in one direction of interest, that is higher than the yield strength of copper and has a thermal conductivity that is higher than the thermal conductivity of stainless steel in another direction of interest.

Base sheet 32 is etched, machined or otherwise formed with upper and lower recesses 40 and 46. Traces 34 and 36 are filled with the secondary material through a process of electroplating, co-rolling, pressing, diffusion bonding or another suitable process. After base sheet 32 is formed, base sheet 32 is left with the full thickness sections of the crowns 42 and 48 and relatively thin reduced sections 56 between crowns 42 and 48.

Composite sheet 30 is structurally reinforced against distortion along the reduced sections 56 by arranging upper and lower crowns 42 and 48 in a pattern with respect to one another as shown in the example in FIG. 3 where dashed lines represent lower crowns 48. In a portion of the pattern, crowns 42 and 48 are aligned in a parallel manner with respect to one another (FIGS. 1 and 2) to extend through the full thickness of the composite sheet 30. In the pattern shown in FIG. 3, another portion of upper crowns 42 are positioned at an angle with respect to lower crowns 48 shown in dashed lines, the angle in this instance is about 90 degrees. Positioning the upper and lower crowns 42 and 48 at an angle with respect to one another prevents reduced sections 56 from defining a straight line through the entire composite sheet 30 along which the sheet could bend. In the pattern shown in FIG. 3 upper surface 50 is represented by solid lines and lower surface 52 is represented by dashed lines. In the portion where upper and lower crowns 42 and 48 run in parallel the dashed lines are not shown since lower crowns 48 are below upper crowns 42. On the other hand, in the portion where upper crowns 42 are angled with respect to lower crowns 48, the lower crowns can be seen as dashed lines. Full thickness areas 53 are defined where upper crowns 42 cross lower crowns 48; partial thickness areas 55 are defined where upper crowns 42 cross lower traces 36; partial thickness areas 57 are defined where upper traces 34 cross lower crowns 48; and reduced thickness areas 59 are defined where upper traces 34 cross lower traces 36.

The pattern shown in FIG. 3 is structurally reinforced against distortion because bending or deformation along one of the reduced sections 56 of the base sheet 32 would also require bending multiple crowns 42 and 48 as well.

Figure 4:
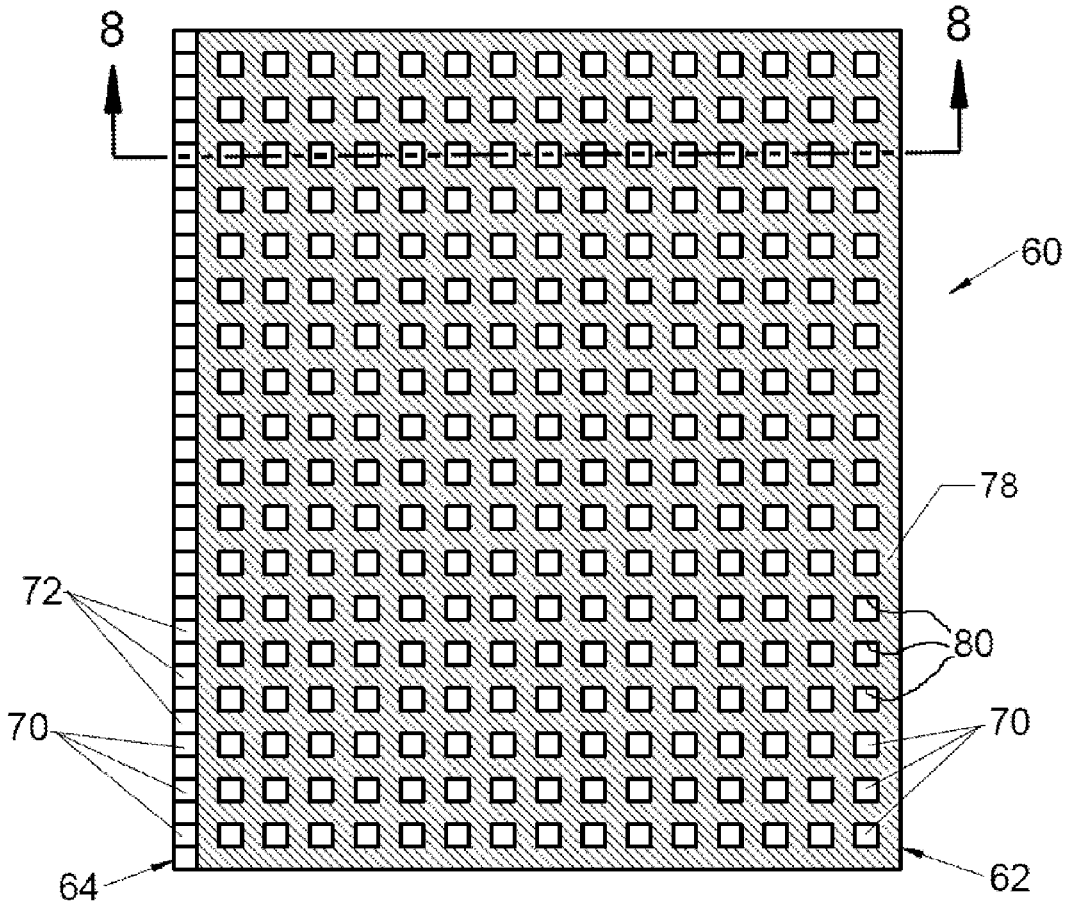
FIG. 4 is a view of another composite sheet which incorporates the present disclosure.
Figure 5:
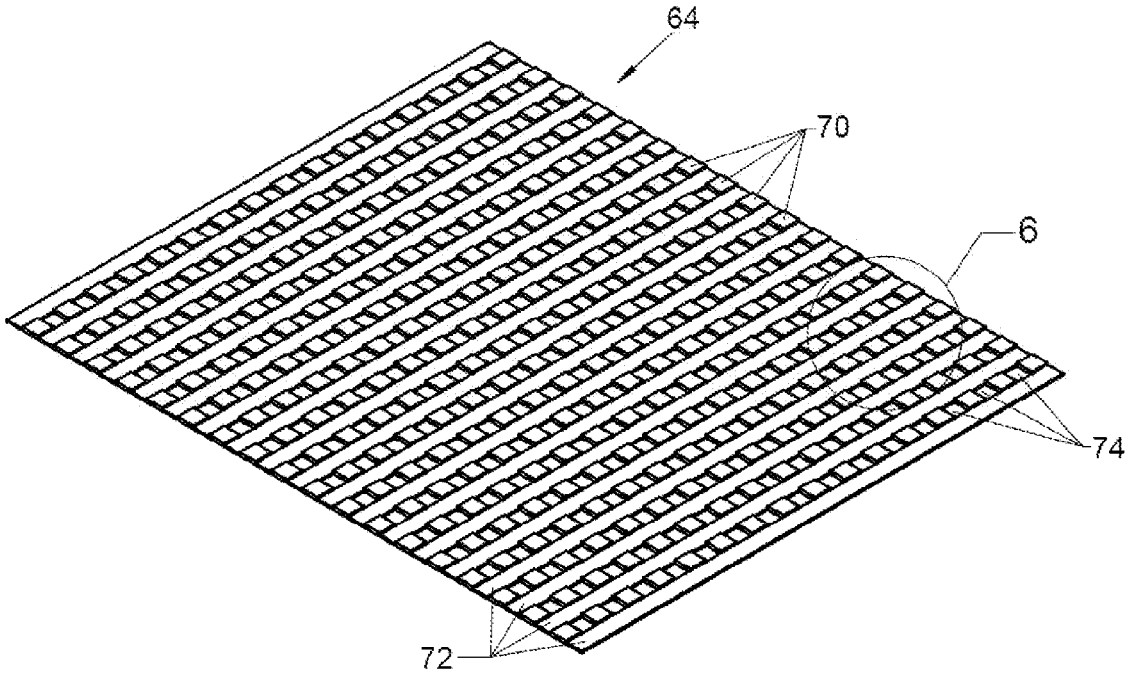
FIG. 5 is a perspective view of a material sheet used in the composite sheet shown in FIG. 4.
Figure 6:
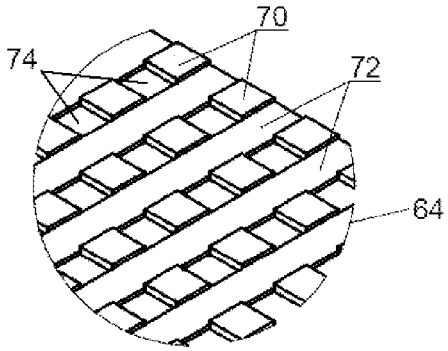
FIG. 6 is an enlarged detail view of the material sheet taken from area 6 shown in FIG. 5.
Figure 7:
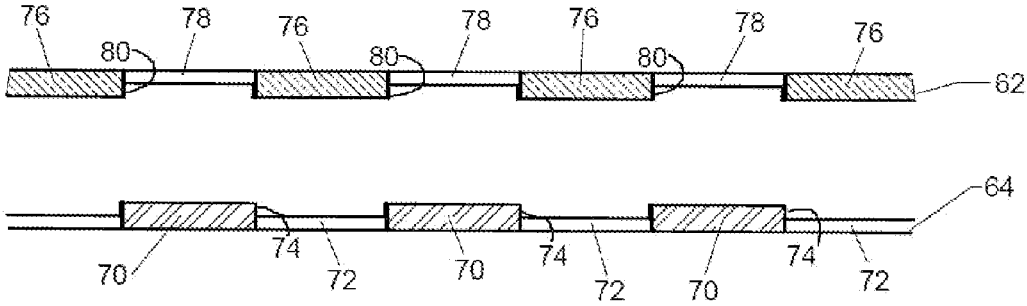
FIG. 7 is an enlarged partial cross section view of the material sheet shown in FIG. 5 shown in a facing relationship along with another material sheet used in the composite sheet shown in FIG. 4.
Figure 8:
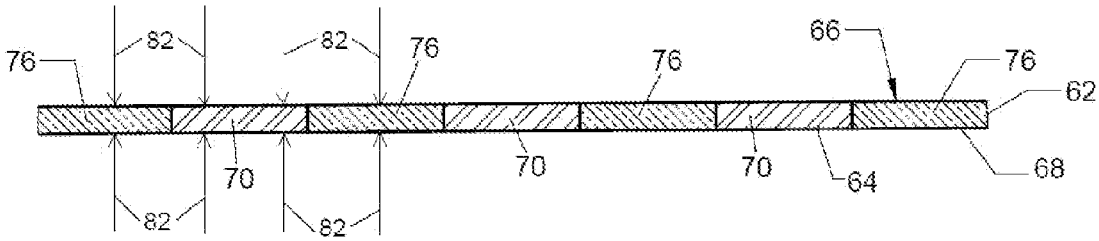
FIG. 8 is an enlarged partial cross section view of the composite sheet taken along line 8-8 shown in FIG. 4.

Another composite sheet 60 according to the present disclosure is shown in FIGS. 4-8. FIG. 4 shows a plan view of composite sheet 60; FIG. 5 shows a perspective view of a lower sheet 74 of composite sheet 60; FIG. 6 shows a detail of lower sheet 74; FIG. 7 shows upper and lower sheets 72 and 74 of composite sheet 60; and FIG. 8 shows a partial cross section view of composite sheet 60. Composite sheet 60 is constructed of upper and lower material sheets 62 and 64 (FIG. 7) into which are etched, machined, stamped or otherwise formed a pattern (FIGS. 5 and 6). The pattern in sheets 62 and 64 are complementary so that when sheet 62 is inverted with respect to sheet 64 as shown in FIG. 7, sheets 62 and 64 fit together to form composite sheet 60 as detailed in FIG. 8. When sheets 62 and 64 are combined into composite sheet 60, the composite sheet has generally planar upper and lower surfaces 66 and 68 (FIG. 8).

The pattern shown in FIGS. 5 and 6 with respect to sheet 64 is the generally the same as for sheet 62. Sheet 64 includes full thickness portions 70, reduced thickness portions 72 and holes 74 and sheet 62 (FIG. 7) includes full thickness portions 76, reduced thickness portions 78 and holes 80. As shown in FIG. 7, inverting sheet 62 with respect to sheet 64 allows full thickness portions 70 of upper sheet 64 to be aligned with holes 80 of lower sheet 64 and full thickness portions 76 of lower sheet 64 to be aligned with holes 74.

Reduced thickness portions 72 and 78 are reduced in thickness relative to full thickness portions 70 and 76, respectively, and are reduced only on one side so that the reduced thickness portion of the upper sheet defines a portion of upper surface 66 and the reduced thickness portion of the lower sheet defines a portion of lower surface 68. In addition, when sheets 62 and 64 are aligned as shown in FIG. 7, reduced thickness portions 72 of upper sheet 62 are aligned with reduced thickness portions 78 of lower sheet 64 to combine into a thickness that is generally equal to the thickness of full thickness portions 70 and 76.

When sheets 62 and 64 are combined into composite sheet 60 as shown in FIG. 8, full thickness portions 70 and 76 extend the entire distance between upper surface 66 and lower surface 68 of composite sheet 60. In this example upper sheet 62 is formed from stainless steel and full thickness portions 70 of upper sheet 62 provide a high compressive strength to resist compressive forces, represented by arrows 82, normal to surfaces 66 and 68 of composite sheet 60 and applied across a sufficiently broad area. Lower sheet 64 in this example is formed from copper so that full and reduced thickness portions 76 and 78 of lower sheet 64 provides a high thermal conductivity characteristic to composite sheet 60. Lower surface 68 of composite sheet 60 is primarily defined by full and reduced thickness portions 76 and 78 of lower sheet 64 with a relatively lesser area defined by full thickness portions 70 of upper sheet 62. Because of this, heat is more efficiently conducted into lower surface 68 of composite sheet 60 due to the relatively larger exposed surface area and configuration of lower sheet 64 at surface 68.

Figure 9:
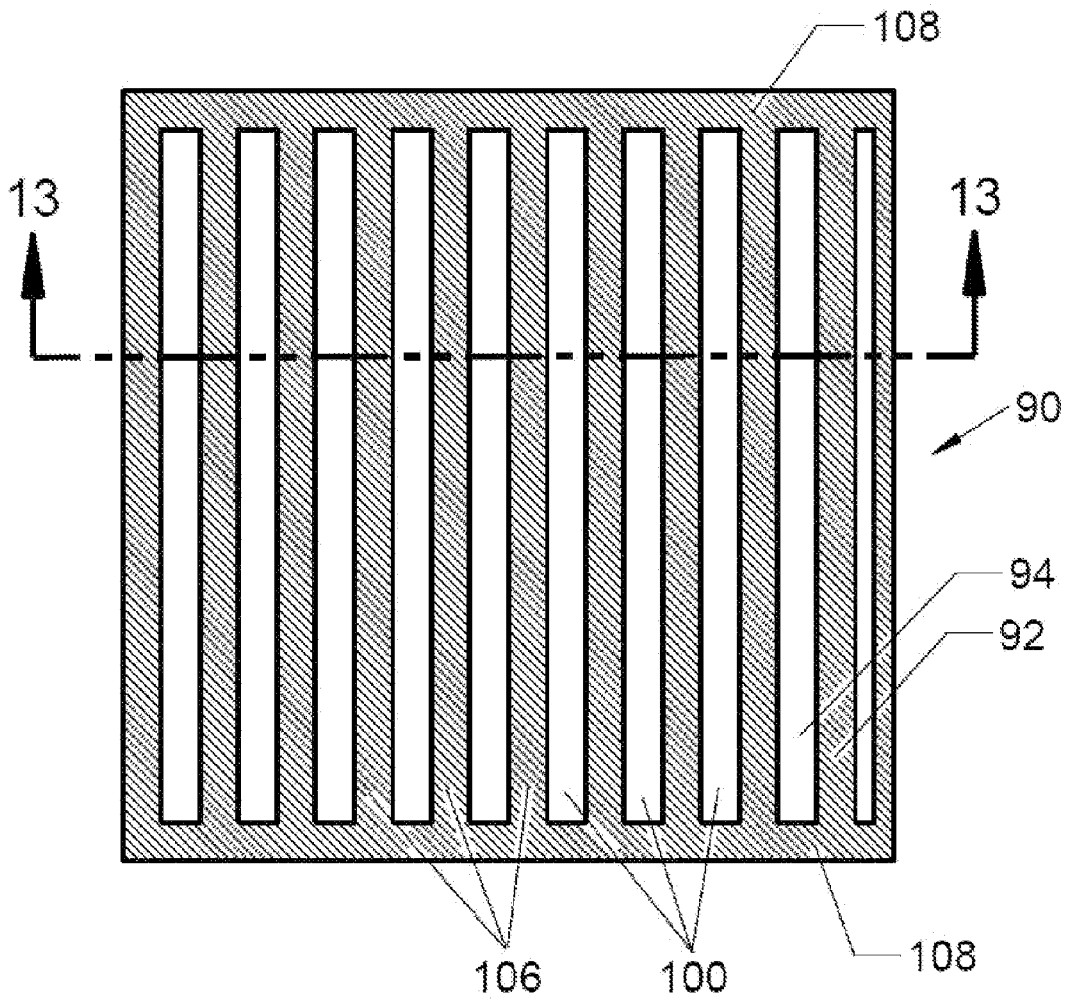
FIG. 9 is a view of yet another composite sheet which incorporates the present disclosure.
Figure 10:
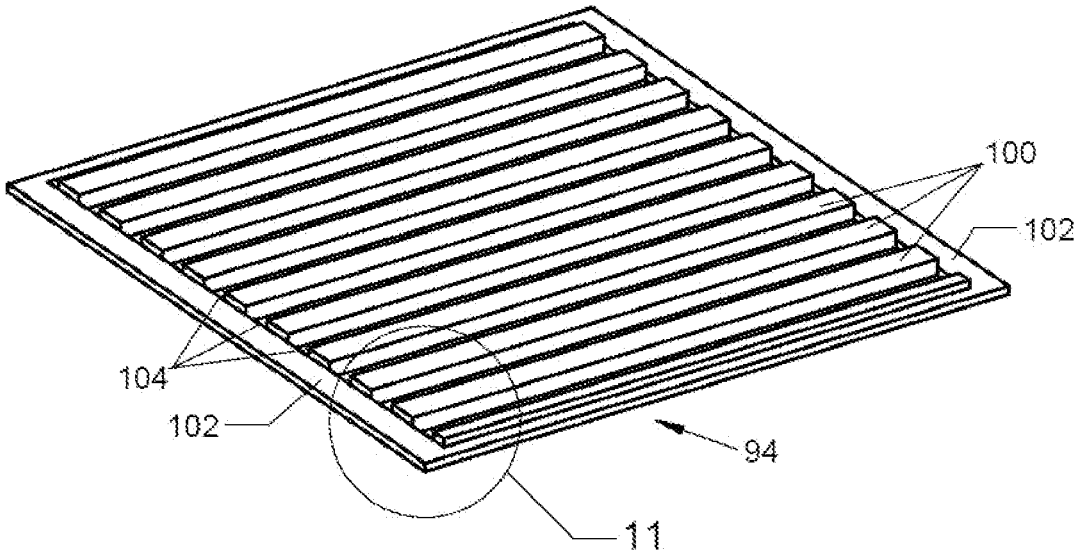
FIG. 10 is a perspective view of a material sheet used in the composite sheet shown in FIG. 9.
Figure 11:
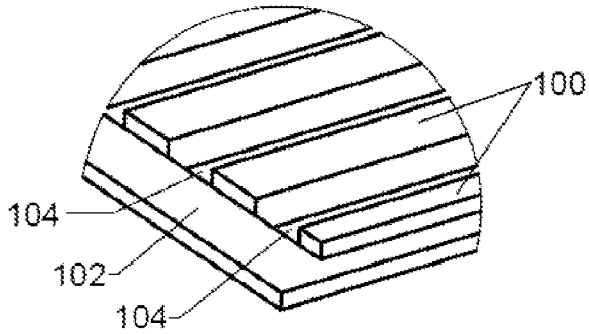
FIG. 11 is an enlarged detail view of the material sheet taken from area 11 shown in FIG. 10.
Figure 12:
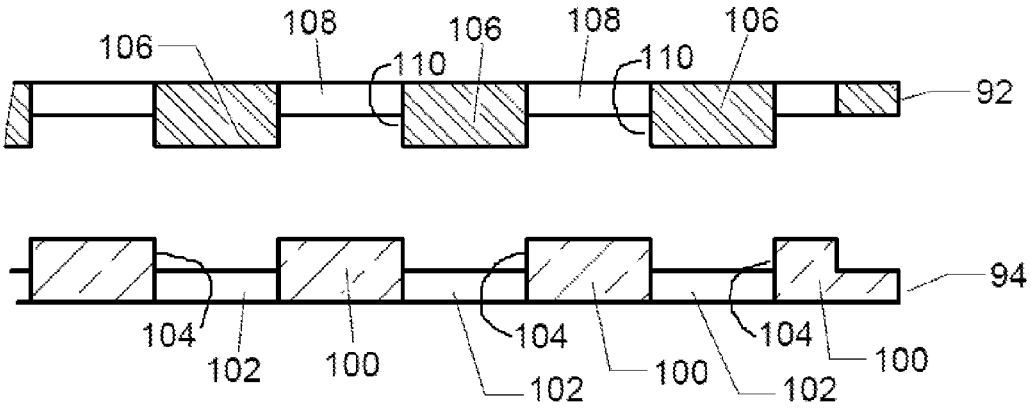
FIG. 12 is an enlarged partial cross section view of the material sheet shown in FIG. 10 shown in a facing relationship along with another material sheet used in the composite sheet shown in FIG. 9.
Figure 13:
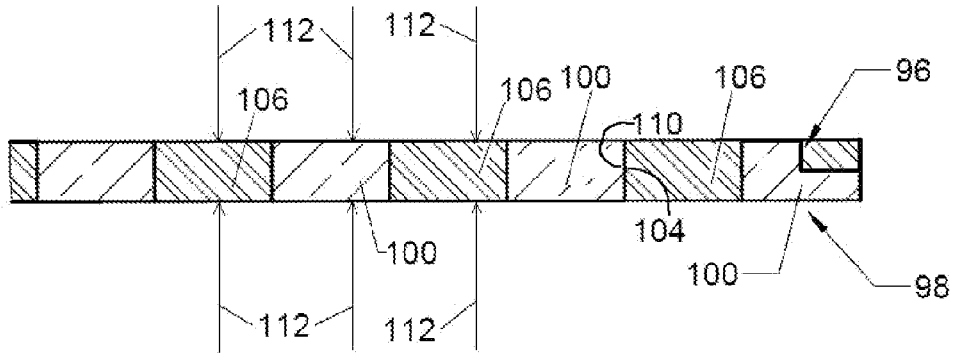
FIG. 13 is an enlarged partial cross section view of the composite sheet taken along line 13-13 shown in FIG. 9.

Yet another composite sheet 90 according to the present disclosure is shown in FIGS. 9-13. FIG. 9 is a plan view of composite sheet 90; FIG. 10 is a perspective view of a lower sheet 94 of composite sheet 90; FIG. 11 is a detail view of lower sheet 94; FIG. 12 shows upper and lower sheets 92 and 94 of composite sheet 90; and FIG. 13 is a partial cross section view of composite sheet 90. Composite sheet 90 is constructed of upper and lower material sheets 92 and 94 into which are etched, machined, stamped or otherwise formed a pattern. The pattern in the sheets 92 and 94 are also complementary so that when the sheet 92 is inverted with respect to sheet 94 as shown in FIG. 12, the sheets 92 and 94 fit together to form the composite sheet 90 as detailed in FIG. 13. When the sheets 92 and 94 are combined into the composite sheet 90, the composite sheet 90 has generally planar upper and lower surfaces 96 and 98 (FIG. 13).

The pattern of the lower sheet 94 shown in FIGS. 10 and 11 is generally the same as for upper sheet 92. Sheet 94 includes full thickness portions 100, reduced thickness portions 102 and holes 104, and sheet 92 (FIG. 12) includes full thickness portions 106, reduced thickness portions 108 and defines holes 110. In this instance of composite sheet 90, full thickness portions 100 and 106 of sheets 92 and 94 have a more elongated shape than full thickness portions 70 and 76 of composite sheet 60 (FIG. 5). Holes 104 and 110 of sheets 92 and 94 are also more elongated so that full thickness portions 100 and 106 fit within holes 110 and 104, respectively. Reduced thickness portions 102 and 108 are positioned at the perimeter of sheets 92 and 94 in the example shown in FIGS. 9-13.

As shown in FIG. 12, positioning sheet 92 inverted with respect to sheet 94 allows full thickness portions 100 of sheet 94 to align with holes 110 of sheet 92 and full thickness portions 106 of sheet 92 to align with holes 104 of sheet 94 for combining sheets 92 and 94 into composite sheet 90 shown in FIG. 13. Full thickness portions 100 and 106 are immediately adjacent to one another and extend between upper surface 96 and lower surface 98 in an alternating manner across the upper and lower surfaces. Sheet 92 is formed from stainless steel or other high yield strength material and full thickness portions 106 of sheet 92 resist compressive forces represented by arrows 112 for a sufficiently wide area of force application.

Figure 14:
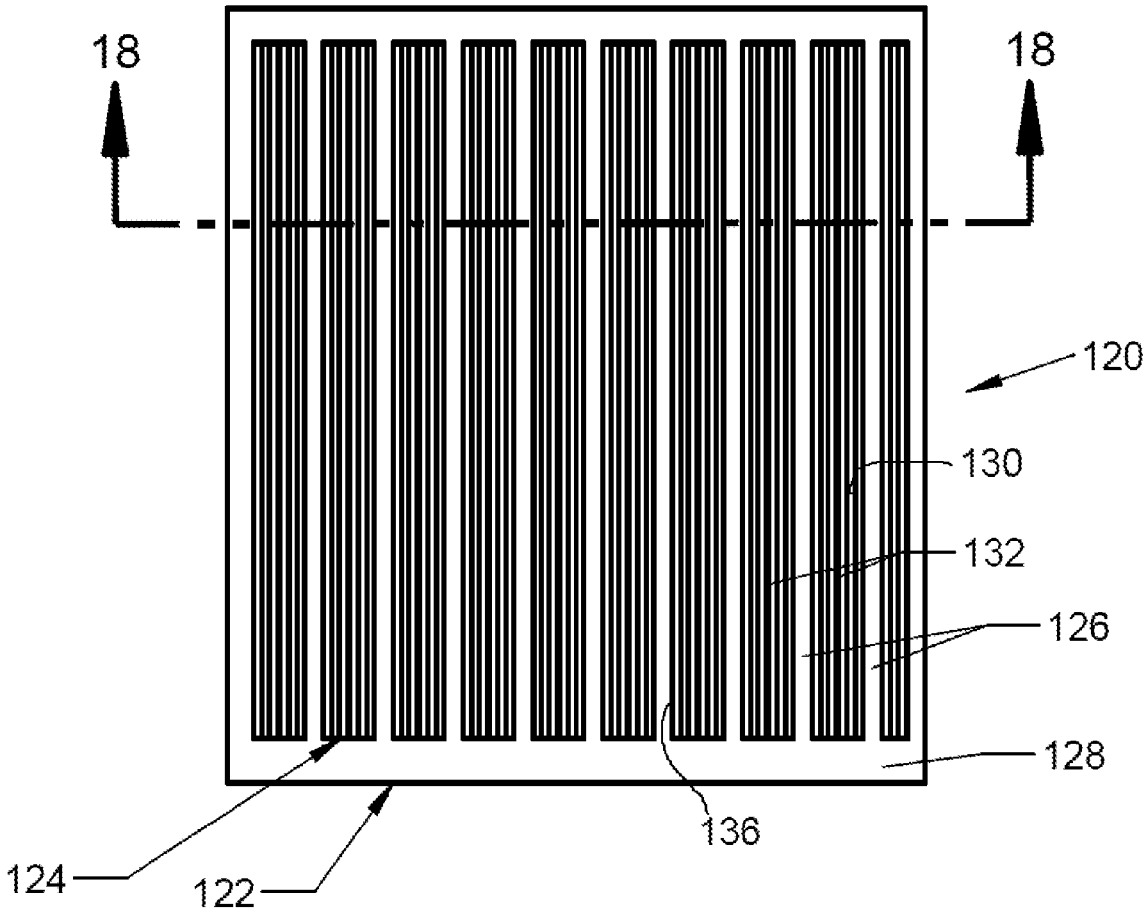
FIG. 14 is a plan view of still another composite sheet which incorporates the present disclosure.
Figure 15:
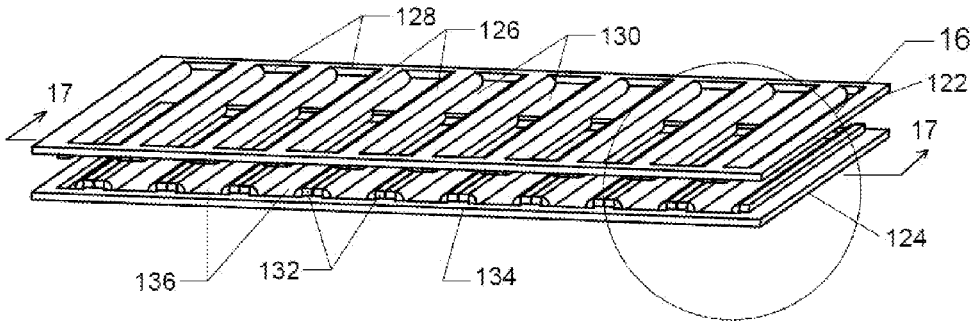
FIG. 15 is a perspective view of material sheets used in the composite sheet shown in FIG. 14, with the material sheets shown in a facing relationship.
Figure 16:
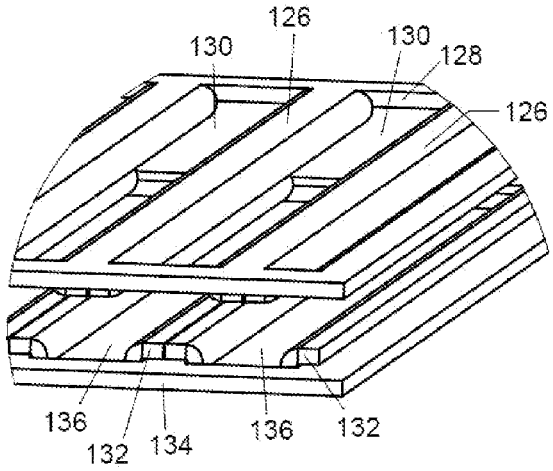
FIG. 16 is an enlarged partial view of the material sheets taken from area 16 shown in FIG. 15.
Figure 17:
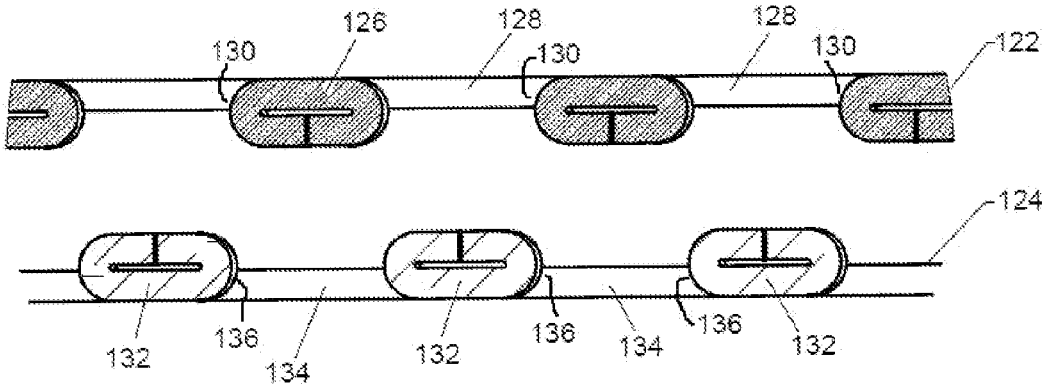
FIG. 17 is an enlarged partial cross section view of the material sheets taken along line 17-17 shown in FIG. 15.
Figure 18:
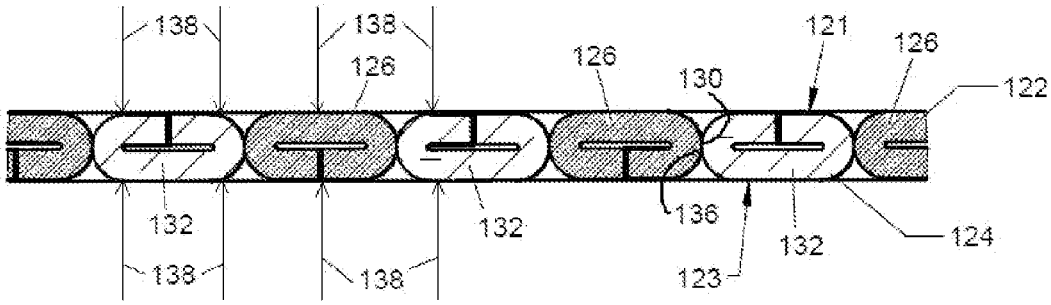
FIG. 18 is an enlarged partial cross section view of the composite sheet taken along line 18-18 shown in FIG. 14.

Yet another composite sheet 120 according to the present disclosure is shown in FIGS. 14-18. FIG. 14 is a plan view of composite sheet 120; FIG. 15 is a perspective view of upper and lower material sheets 122 and 124 of composite sheet 120; FIG. 16 is a detail view of upper and lower sheets 122 and 124; FIG. 17 shows a partial cross section view of upper and lower sheets 122 and 124; and FIG. 18 is a partial cross section view of composite sheet 120. Composite sheet 120 is constructed of upper and lower material sheets 122 and 124 (FIG. 15). Sheet 122 (FIG. 17) includes full thickness portions 126, reduced thickness portions 128 and holes 130, and sheet 124 includes full thickness portions 132, reduced thickness portions 134 and define holes 136. Sheet 122 is formed into the pattern shown in FIGS. 15-18 by starting with a sheet of high yield strength material, such as stainless steel, with a thickness that is equal to the reduced thickness portions 128 of sheet 122 and folding over sections of the sheet of material against itself by stamping or otherwise forming the material. Folding the sections of the sheet creates full thickness portions 126 where the material is folded over against itself, and creates holes 130 where the material is displaced during the folding process. The sheets 122 and 124 are combined into composite sheet 120, composite sheet 120 has generally planar upper and lower surfaces 121 and 123 (FIG. 13).

Sheet 124 is formed in a manner similar to that of sheet 122, except the material is a high thermal conductivity material such as copper, and holes 136 are created by folding material from the holes 136 over to create the full thickness portions 132. After the patterns are formed into sheets 122 and 124, the sheets are positioned as shown in FIG. 17 and then combined as shown in FIG. 18 into the composite sheet 120. As before, the full thickness portions 126 of the steel have a high yield strength that resists compressive and other forces represented in this instance by arrows 138 when such forces are applied over an appropriate surface area.

Figure 19:
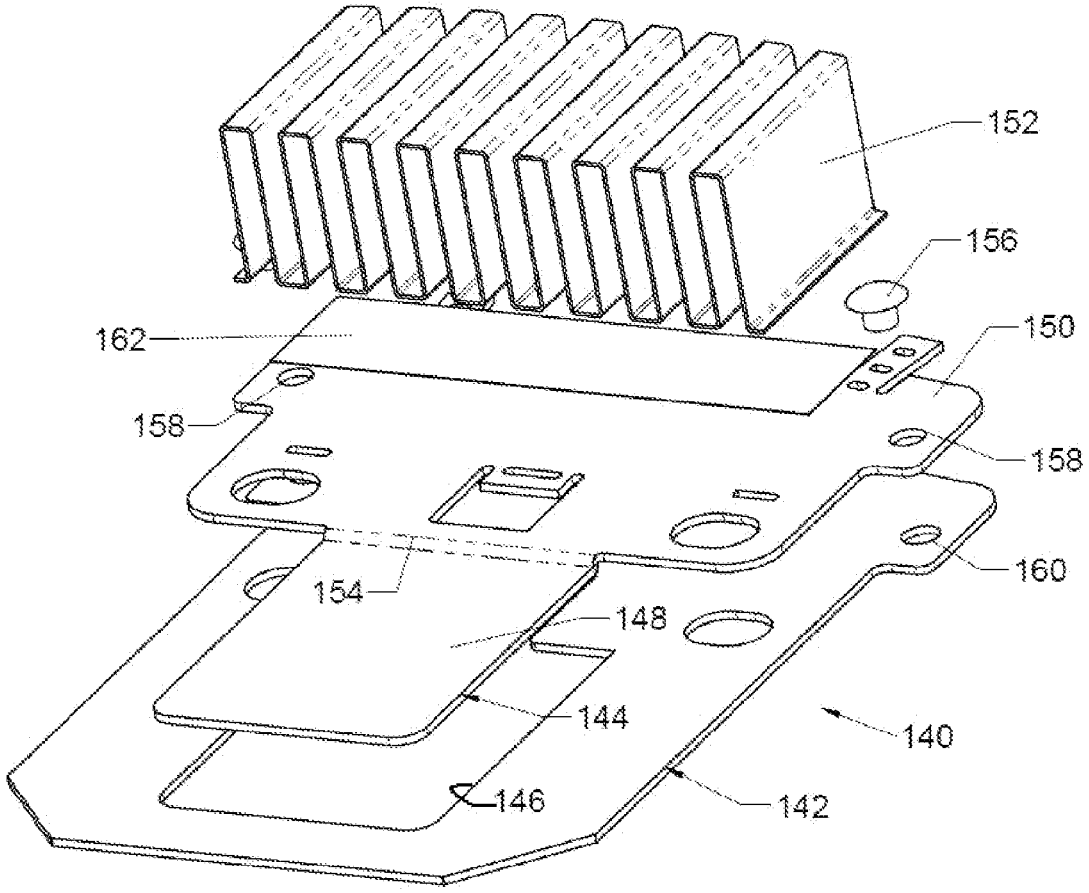
FIG. 19 is a perspective view of material sheets which combine into another composite sheet according to the present disclosure.

Another composite sheet 140 according to the present description is shown in FIG. 19. In this instance composite sheet 140 is formed by combining a high yield strength material sheet 142 with a high thermal conductivity material sheet 144 which have complementary shapes. Sheet 142 defines a hole 146 in which a heat pickup portion 148 of sheet 144 fits. When sheets 142 and 144 are combined, heat pickup portion 148 is positioned in hole 146 and the combination of heat pickup portion 148 and sheet 142 surrounding hole 146 generally define a planar surface of conductive sheet 140. Sheet 144 also includes a heat sink portion 150 which is sandwiched between sheet 142 and a heat sink 152 in a brake cooling apparatus. A step 154 of sheet 144 transitions between heat pickup portion 148 and heat sink portion 150 of sheet 144. Step 154 allows heat pickup portion 148 to be positioned in hole 146 of sheet 142 and heat sink portion 150 to be positioned at the surface of sheet 142. In the embodiment shown in FIG. 19, sheets 142 and 144 are connected to one another with rivets 156 which extend through rivet holes 158 and 160. Heat sink 152 is connected to sheet 144 with braze material 162 that is heated to bond heat sink 152 to sheet 144.

Several embodiments of composite sheets have been shown in which one material with a desirable property is interlaced with another material having a different desirable property to obtain a composite having a combination of both desired properties not achievable with either the primary or secondary material alone. When constructed of high yield strength materials and high thermal conductivity materials, the resulting composite sheet is able to withstand forces that are greater than could be withstood with the high thermal conductivity material when such forces are applied to a portion of the surface area of the composite sheet that includes the high strength material. Additionally, such a composite sheet is also able to conduct heat much more readily than could be accomplished using the high compressive strength material alone.

One instance where the composite sheets described herein are useful for resisting compressive forces of a high temperature piston, such as found in disk brake systems. The high yield strength of the composite prevents the composite sheet from deforming under the compressive stress imposed by the piston, even at elevated temperatures. The high thermal conductivity material of the composite sheet moves heat away from the piston.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A three dimensional composite sheet having first and second major surfaces defined by a first and second dimension of the composite sheet and a thickness defined by a third dimension extending between the first and second major surfaces of the composite sheet, the major surfaces defining outermost boundaries of the composite sheet that are externally disposed, the composite sheet having a first material and a second material which combine to give the composite sheet a compressive strength that is higher than a compressive strength of the second material and a thermal conductivity that is higher than a thermal conductivity of the first material, said composite sheet comprising:

a first major surface area defining at least a first portion of the first major surface which includes the first sheet material arranged in a first array of shapes in said first portion of the first major surface surrounded by the second sheet material, the first sheet material for primarily withstanding a compressive force substantially normal to the first major surface and the second sheet material for primarily conducting heat; and a second major surface area defining at least a second portion of the second major surface which includes the second material arranged in a second array of shapes on said second portion of the second major surface surrounded by the first sheet material, where the first sheet material extends completely through the thickness of the composite sheet to extend the first array of shapes from the first major surface to the second major surface, and the second sheet material extends completely through the thickness of the composite sheet to extend the second array of shapes from the second major surface to the first major surface.

2. The composite sheet of claim 1 wherein each shape of the first sheet material that makes up the first array of shapes is square.

* * * * *